US008677879B1

(12) United States Patent
Gresham et al.

(10) Patent No.: US 8,677,879 B1
(45) Date of Patent: Mar. 25, 2014

(54) FIREARM COOLING DEVICE

(76) Inventors: Jeff S. Gresham, St. Joseph, MO (US); Terry Calhoon, St. Joseph, MO (US)

( * ) Notice: Subject to any disclaimer, the term of this patent is extended or adjusted under 35 U.S.C. 154(b) by 42 days.

(21) Appl. No.: 13/486,134

(22) Filed: Jun. 1, 2012

(51) Int. Cl.
*F41A 13/04* (2006.01)

(52) U.S. Cl.
USPC ..... 89/14.1; 42/90; 42/94; 42/106

(58) Field of Classification Search
USPC ..... 42/106, 90, 94; 89/14.1
See application file for complete search history.

(56) References Cited

U.S. PATENT DOCUMENTS

| | | | | |
|---|---|---|---|---|
| 2,774,281 | A | 12/1956 | Hawkins | |
| 6,311,602 | B1 | 11/2001 | Gerber et al. | |
| 6,591,732 | B2 | 7/2003 | Gerber et al. | |
| 7,594,463 | B2 | 9/2009 | Skinner | |
| 2009/0049732 | A1 * | 2/2009 | Kissinger | 42/106 |
| 2010/0192759 | A1 * | 8/2010 | Garwood | 89/12 |
| 2012/0255212 | A1 * | 10/2012 | Werner | 42/90 |

* cited by examiner

*Primary Examiner* — Stephen M Johnson

(57) ABSTRACT

A firearm cooling device that includes a briefcase with a lockable lid, an adjustable firearm mount disposed upon the briefcase lid, an air pump disposed within a compartmentalized housing disposed within the briefcase, a rechargeable battery disposed within the compartmentalized housing, said battery in circuit with the air pump, an air vent disposed upon the briefcase in open communication with the air pump, an outlet port disposed upon the briefcase in open communication with the air pump, and an air hose releasably connectable to the outlet port, wherein an extant firearm is supportable within the adjustable firearm mount and air forcibly expelled by the air pump through the air hose is directable proximal the barrel of said firearm to more efficiently radiate heat therefrom whereby said firearm is more rapidly cooled thereby.

10 Claims, 3 Drawing Sheets

FIG. 3
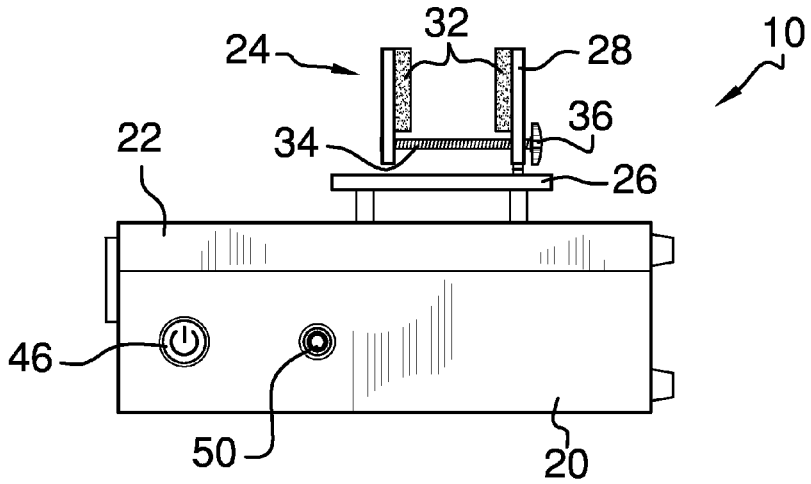
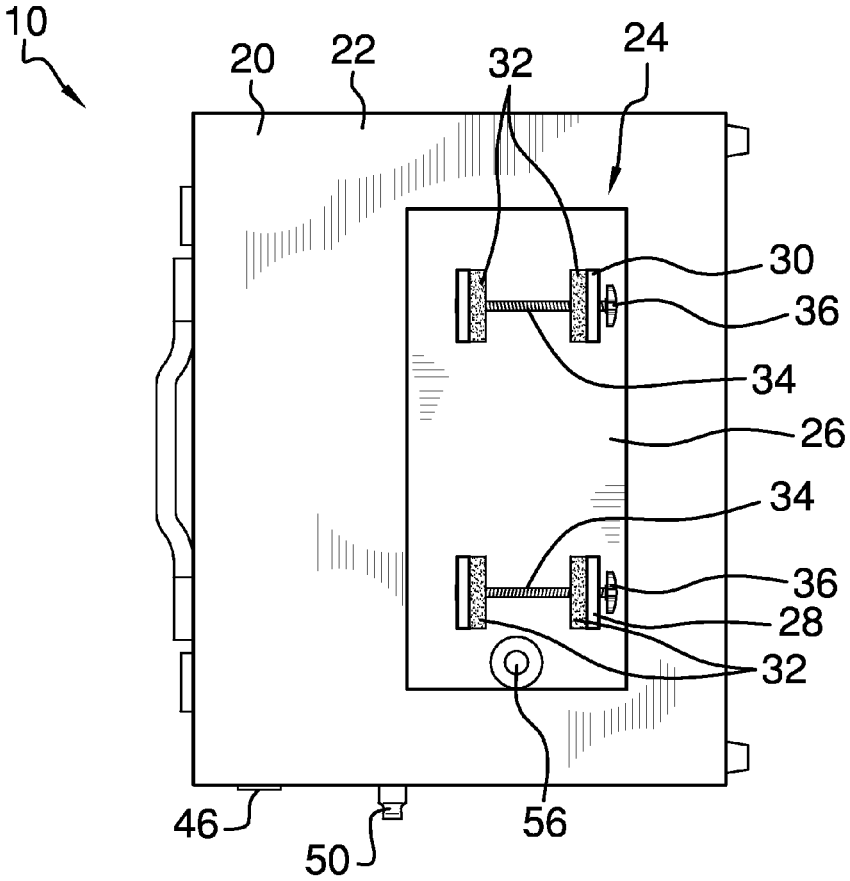
FIG. 4

FIREARM COOLING DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of firearm cooling devices are known in the prior art. However, what is needed is a firearm cooling device that includes a briefcase with a lockable lid, an adjustable firearm mount disposed upon the briefcase lid, an air pump disposed within a compartmentalized housing disposed within the briefcase, a rechargeable battery disposed within the compartmentalized housing, said battery in circuit with the air pump, an air vent disposed upon the briefcase in open communication with the air pump, an outlet port disposed upon the briefcase in open communication with the air pump, and an air hose releasably connectable to the outlet port, wherein an extant firearm is supportable within the adjustable firearm mount and air forcibly expelled by the air pump through the air hose is directable proximal the barrel of said firearm to more efficiently radiate heat therefrom whereby said firearm is more rapidly cooled thereby.

FIELD OF THE INVENTION

The present invention relates to a firearm cooling device, and more particularly, to a firearm cooling device that includes a briefcase with a lockable lid, an adjustable firearm mount disposed upon the briefcase lid, an air pump disposed within a compartmentalized housing disposed within the briefcase, a rechargeable battery disposed within the compartmentalized housing, said battery in circuit with the air pump, an air vent disposed upon the briefcase in open communication with the air pump, an outlet port disposed upon the briefcase in open communication with the air pump, and an air hose releasably connectable to the outlet port, wherein an extant firearm is supportable within the adjustable firearm mount and air forcibly expelled by the air pump through the air hose is directable proximal the barrel of said firearm to more efficiently radiate heat therefrom whereby said firearm is more rapidly cooled thereby.

SUMMARY OF THE INVENTION

The general purpose of the firearm cooling device, described subsequently in greater detail, is to provide a firearm cooling device which has many novel features that result in a firearm cooling device which is not anticipated, rendered obvious, suggested, or even implied by prior art, either alone or in combination thereof.

The present invention has been devised to enable safe storage and transport of an extant firearm and relevant ammunition, while enabling a more efficient cooling means for said firearm when the firearm is repeatedly discharged. The present firearm cooling device includes a briefcase having a securable lid and an adjustable firearm mount disposed upon the lid. The briefcase is therefore usable as a support during firing of the firearm when a shooter is engaged in hunting, or when a person is otherwise actively discharging a weapon with a frequency of rounds fired. An extant firearm is releasably securable within the adjustable firearm mount by means of a first vice and a second vice configured to releasably receive a firearm therein. In the preferred embodiment herein disclosed, said extant firearm is illustrated as a rifle. However, the device should not be considered limited for use with rifles, or any specific make or model of rifle.

The firearm is supported in the adjustable firearm mount by means of a screw pin disposed upon each of the first vice and the second vice. When a manually operable handle member, disposed on each of the first vice and the second vice, is rotated, the respective screw pin also rotates, and the respective first vice and second vice is thereby movable between an open position and a closed position. When the first vice and second vice are moved to the open position, the firearm is readily positional within the adjustable firearm mount. When each of the first vice and the second vice are thereafter moved to the closed position, a pair of padded members disposed upon each of the first vice and the second vice are moved to releasably engaged with the firearm and secure the firearm in a desired position within the adjustable firearm mount.

Each of the first vice and the second vice are disposed upon a platform, said platform disposed upon the lid of the briefcase. In the preferred embodiment herein disclosed, each of the first vice and the second vice include a pair of wall members disposed in parallel, each of the pair of wall members disposed perpendicularly with respect to the platform. When the screw pin rotates, one of each of the pair of wall members is moveable along said screw pin towards the other of each of the pair of wall members. Each of each pair of padded members is disposed upon each of each pair of wall members.

The firearm is further supported by means of a spring support compressibly disposed upon the platform. The spring support compressibly supports the stock of a firearm positioned with the adjustable firearm mount.

The cooling means of the instant firearm cooling device includes an air pump disposed within a compartmentalized housing within the briefcase. The air pump is in open communication with an air vent disposed upon the briefcase. When the air pump is activated, by means of an on/off switch disposed exteriorly upon the briefcase, air from the ambient surroundings is drawn into the air vent and then forced to an outlet port disposed upon the briefcase. A flexible air hose is releasably connectable to the outlet port, the air hose connecting to the outlet port exteriorly with respect to the briefcase, and said hose is positional proximal the barrel of the firearm when the firearm is releasably secured within the adjustable firearm mount. Thusly, when the pump is activated, air is drawn in through the air vent and forcibly directed through the air hose and expelled proximal the barrel of the firearm to more efficiently transfer heat from the barrel of said firearm as the firearm is discharged.

To power the air pump, a rechargeable battery is disposed within the compartmentalized housing, said battery in circuit with the air pump and the on/off switch. The compartmentalized housing further includes a plurality of storage bays for storing ammunition proximal to the firearm. The firearm is also storable within the compartmentalized housing when said firearm is disassembled.

Thus has been broadly outlined the more important features of the present firearm cooling device so that the detailed description thereof that follows may be better understood and in order that the present contribution to the art may be better appreciated.

Objects of the present firearm cooling device, along with various novel features that characterize the invention are particularly pointed out in the claims forming a part of this disclosure. For better understanding of the firearm cooling device, its operating advantages and specific objects attained by its uses, refer to the accompanying drawings and description.

BRIEF DESCRIPTION OF THE DRAWINGS

Figures

FIG. 3 is a side view.
FIG. 4 is a top view.

DETAILED DESCRIPTION OF THE DRAWINGS

Figure 1:
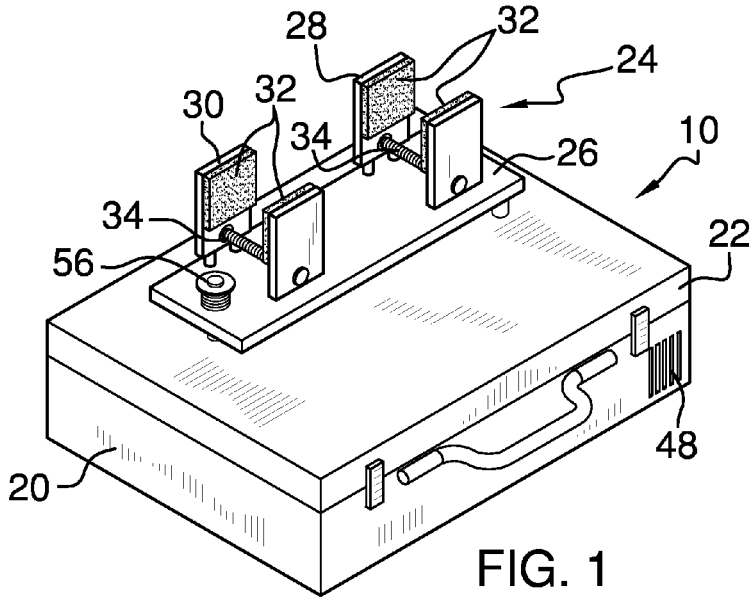
FIG. 1 is an isometric view.
Figure 2:
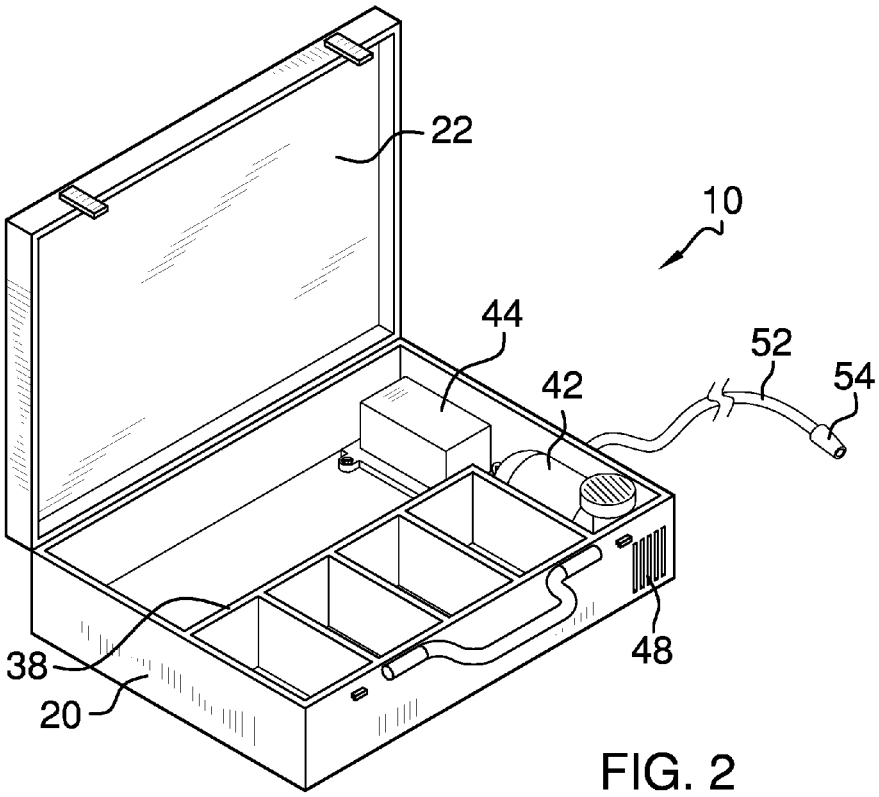
FIG. 2 is an isometric view with a securable lid opened.
Figure 5:
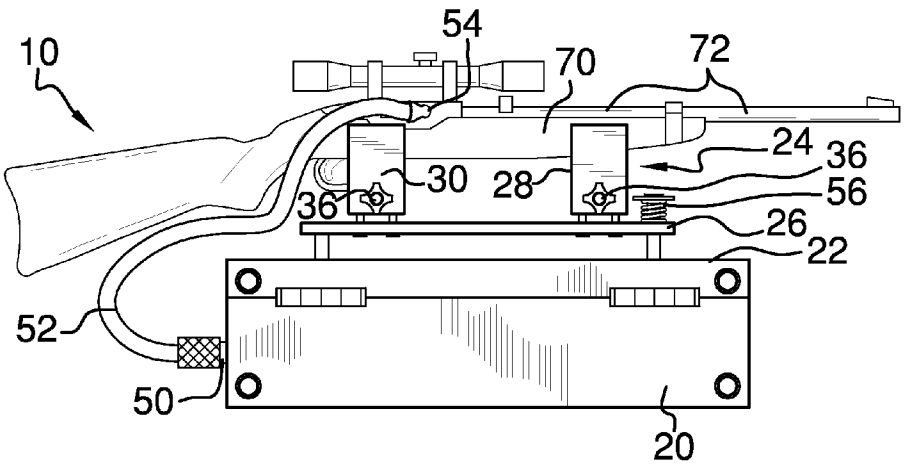
FIG. 5 is an in-use view.
Figure 6:
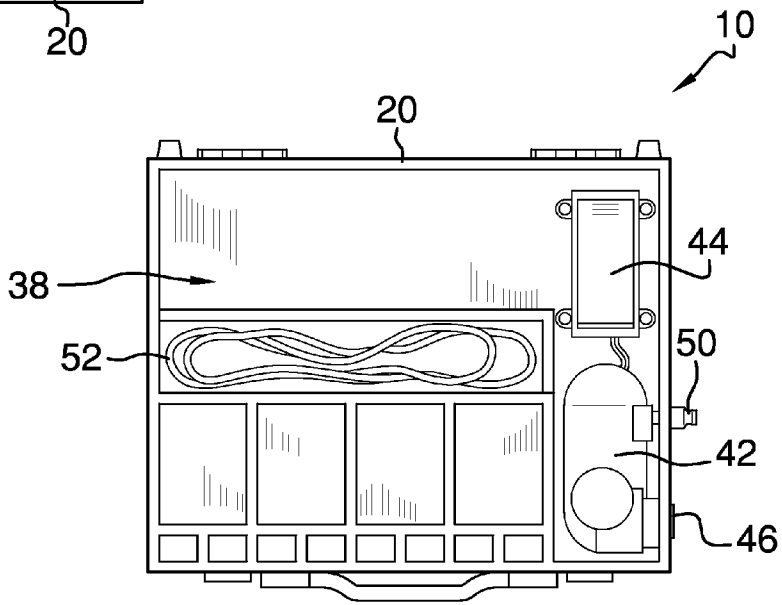
FIG. 6 is a top view with the lid removed.

With reference now to the drawings, and in particular FIGS. 1 through 4 thereof, example of the instant firearm cooling device employing the principles and concepts of the present firearm cooling device and generally designated by the reference number 10 will be described.

Referring to FIGS. 1 through 4 a preferred embodiment of the present firearm cooling device 10 is illustrated.

The present firearm cooling device 10 has been devised to securably house a firearm 70, ammunition (not shown), and releasably secure said firearm 70 to a brief case 20 whereby air from the ambient surrounding is forcibly discharged proximal the barrel 72 of said firearm 70 to more efficiently radiate heat from the barrel 72 of the firearm 70 after the firearm 70 is repeatedly discharged.

The present firearm cooling device 10 includes a briefcase 20 having a securable lid 22 and an adjustable firearm mount 24 disposed upon the briefcase 20. The adjustable firearm mount 24 includes a platform 26 disposed upon the lid 22 of the briefcase 20, a first vice 28 disposed upon the platform 26 and a second vice 30 disposed upon the platform 26. A pair of padded members 32, configured to releasably engage with an extant firearm 70 mounted to the adjustable firearm mount 24, is disposed on each of the first vice 28 and the second vice 30. Each pair of padded members 32 is configured to releasably engage with a firearm 70 mounted to the adjustable firearm mount 24 when said first vice 28 and second vice 30 are moved from an open position to a closed position.

A rotatable screw pin 34 is rotatably disposed on each of the first vice 28 and the second vice 30, said screw pin 34 manually operable by means of a handle member 36 disposed upon each screw pin 34. Each of the first vice 28 and the second vice 30 are thereby moveable between an open position and a closed position by means of the screw pin 34 and each of the first vice 28 and the second vice 30 are adjustable to releasably secure a firearm 70 therebetween.

For further support of the firearm 70, spring support 56 is included. The spring support 56 is configured to compressibly support a firearm mounted to the adjustable firearm mount 24. The spring support 56 is compressibly disposed upon the platform 26 of the adjustable firearm mount 24 and may be compressibly engaged by the stock of a firearm 70 positioned thereto. The spring support 56 may be positioned at either end of the platform 26 and the firearm 70 mounted in a direction independent thereof.

A compartmentalized housing 38 is disposed within the briefcase 20. The compartmentalized housing 38 includes a plurality of storage bays 40 configured to secureably house extant ammunition (not shown), as desired. The compartmentalized housing 38 is configured to securely store extant ammunition within the plurality of storage bays 40, and also an extant firearm 70 when said firearm 70 is disassembled. The briefcase 20 is lockable to securely house said firearm 70 and ammunition, as desired, for transport or storage.

An air pump 42 is also disposed within the compartmentalized housing 38. To power the air pump 42, a rechargeable battery 44 is disposed within the compartmentalized housing 38, said battery 44 in circuit with the air pump 42. To activate and deactivate the air pump 42, as desired, an on/off button 46 is disposed exteriorly upon the briefcase 20, said on/off button 46 in operational communication with the air pump 42.

An air vent 48 is disposed upon the briefcase 20, said air vent 48 in open communication with the air pump 42. When the air pump 42 is activated by means of the on/off button 46, the air pump 42 draws air from the ambient environment through the air vent 48. A filter (not shown) is disposed within the air pump 48 to exclude dust and other atmospheric debris from contaminating the air pump 42

The air pump 42 is in open communication with an outlet port 50. The outlet port 50 is disposed upon the briefcase 20. Air drawn through the air vent 48 by means of the air pump 42 is forcibly communicated to the outlet port 50 when the air pump 42 is activated. An air hose 52 is releasably connectable to the outlet port 50, said air hose 52 configured to be rapidly connectable to the outlet port 52, said air hose 52 connectable exteriorly with respect to the briefcase 20. A nozzle 54 is disposed endwise upon the air hose 52. The air hose 52 is storable within the compartmentalized housing 38 when not in use (see FIG. 8).

An extant firearm 70 is thereby supportable in the adjustable firearm mount 24 and the air pump 42 is activatable whereby air drawn in through the air vent 48 is forcibly pumped through the air hose 52 (when said air hose 52 is releasably connected to the outlet port 50), and the air is subsequently dispelled and forcibly directed from the nozzle 54 to cool the barrel 72 of said firearm 70 when said firearm 70 is repeatedly discharged.

The adjustable firearm mount 24 is configured to releasably secure a firearm 70 to the briefcase 20 and the air hose 52 is configured to be positional proximal to the barrel 72 of said firearm 70, whereby air drawn through the air vent 48 is forcibly discharged proximal the barrel 72 to more efficiently transfer heat from said barrel 72 when the firearm 70 is discharged. The firearm 70 is thereby cooled by the application of air forcibly discharged thereto, and the frequency of rounds viably discharged from said firearm 70 is thereby increased.

What is claimed is:

1. A firearm cooling device comprising:
a lockable briefcase;
an adjustable firearm mount disposed upon the briefcase;
an air pump disposed within the brief case;
an air vent disposed upon the briefcase, said air vent in open communication with the air pump;
an outlet port disposed upon the briefcase, said outlet port in open communication with the air pump;
an air hose releasably connectable to the outlet port;
a nozzle disposed endwise upon the air hose;

wherein an extant firearm is supportable in the firearm mount and the air pump is activatable whereby air drawn in through the air vent is forcibly pumped through the air hose, said air dispelled and directed from the nozzle to cool the barrel of said firearm when said firearm is repeatedly discharged.

2. The firearm cooling device of claim 1 wherein the adjustable firearm mount further comprises:

a platform disposed upon a lid of the briefcase;

a first vice disposed upon the platform;

a second vice disposed upon the platform;

wherein each of the first vice and the second vice are adjustable to releasably secure a firearm therebetween whereby the air hose is positional proximal the barrel of said firearm.

3. The firearm cooling device of claim 2 wherein each of the first vice and the second vice further comprises:

a pair of padded members configured to releasably engage with an extant firearm mounted to the adjustable firearm mount when said first vice and second vice are moved from an open position to a closed position;

a screw pin;

wherein each of the first vice and the second vice are moveable between an open position and a closed position by means of the screw pin.

4. The firearm cooling device of claim 3 wherein each screw pin is rotatably adjustable by means of a manually operable handle member.

5. The firearm cooling device of claim 2 wherein an on/off button is disposed upon the briefcase exterior, said on/off button operationally activating and deactivating the air pump.

6. The firearm cooling device of claim 5 further comprising a rechargeable battery disposed within a compartmentalized housing disposed within the briefcase, said battery disposed in circuit with the air pump and the on/off button.

7. The firearm cooling device of claim 6 wherein the compartmentalized housing further comprises a plurality of storage bays whereby ammunition, an extant disassembled firearm, and the air hose is storable within the briefcase.

8. The firearm cooling device of claim 7 wherein a spring support is mounted atop the platform, said spring support configured to compressibly support the stock of a firearm mounted to the adjustable firearm mount.

9. A firearm cooling device comprising:

a briefcase having a securable lid;

an adjustable firearm mount disposed upon the briefcase, said adjustable firearm mount comprising:

a platform disposed upon the lid of the briefcase;

a first vice disposed upon the platform;

a second vice disposed upon the platform;

a pair of padded members configured to releasably engage with an extant firearm mounted to the adjustable firearm mount when said first vice and second vice are moved from an open position to a closed position;

a rotatable screw pin;

a manually operable handle member disposed upon the screw pin;

wherein each of the first vice and the second vice are moveable between an open position and a closed position by means of the screw pin and each of the first vice and the second vice are adjustable to releasably secure a firearm therebetween;

a compartmentalized housing disposed within the briefcase;

an air pump disposed within the compartmentalized housing;

a battery disposed within the compartmentalized housing, said battery in circuit with the air pump;

an on/off button disposed exteriorly upon the briefcase, said on/off button in operational communication with the air pump;

an air vent disposed upon the briefcase, said air vent in open communication with the air pump;

an outlet port disposed upon the brief case, said outlet port in open communication with the air pump;

an air hose releasably connectable to the outlet port, said air hose connectable exteriorly to the briefcase;

a nozzle disposed endwise upon the air hose;

wherein an extant firearm is supportable in the firearm mount and the air pump is activatable whereby air drawn in through the air vent is forcibly pumped through the air hose, said air dispelled and directed from the nozzle to cool the barrel of said firearm when said firearm is repeatedly discharged.

10. The firearm cooling device of claim 9 wherein the compartmentalized housing is configured to securely store extant ammunition within a plurality of storage bays, an extant firearm when said firearm is disassembled, and the air hose when not in use.

* * * * *